US011686197B2

(12) United States Patent
Moodie et al.

(10) Patent No.: US 11,686,197 B2
(45) Date of Patent: Jun. 27, 2023

(54) ULTRASONIC THROUGH BARRIER COMMUNICATION SYSTEM FOR IN RISER COMMUNICATION

(71) Applicant: FMC Technologies, Inc., Houston, TX (US)

(72) Inventors: David George Moodie, Houston, TX (US); Alan Graham, Houston, TX (US); Scott David Petrie, Houston, TX (US); John Cristopher Whelan, Houston, TX (US); Norman Lewis Mackenzie, Houston, TX (US); Steven William Bremner, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 17/810,762

(22) Filed: Jul. 5, 2022

(65) Prior Publication Data

US 2022/0364463 A1 Nov. 17, 2022

Related U.S. Application Data

(63) Continuation of application No. 17/256,714, filed as application No. PCT/US2018/040798 on Jul. 3, 2018, now abandoned.

(51) Int. Cl.

| | |
|---|---|
| ***E21B 47/18*** | (2012.01) |
| ***E21B 47/16*** | (2006.01) |
| ***E21B 47/14*** | (2006.01) |

(52) U.S. Cl.

CPC ..... *E21B 47/18* (2013.01); *E21B 47/16* (2013.01)

(58) Field of Classification Search

None

See application file for complete search history.

(56) References Cited

U.S. PATENT DOCUMENTS

| | | | | |
|---|---|---|---|---|
| 9,103,204 | B2 | 8/2015 | Yates | |
| 2006/0042791 | A1 * | 3/2006 | Hosie | E21B 33/064 166/100 |

(Continued)

FOREIGN PATENT DOCUMENTS

| | | | | |
|---|---|---|---|---|
| CN | 106907143 | A | 6/2017 | |
| WO | WO-2012048192 | A2 * | 4/2012 | E21B 47/16 |

(Continued)

OTHER PUBLICATIONS

IntelliServ Product Catalog, intelliserv@nov.com, D392004875-MKT-001 Rev. 03, 2015 (7 pages).

(Continued)

*Primary Examiner* — Curtis A Kuntz

*Assistant Examiner* — Jerold B Murphy

(74) *Attorney, Agent, or Firm* — Osha Bergman Watanabe & Burton LLP

(57) ABSTRACT

A communication system employed during wellbore operations, such as during drilling, cementing, fracturing, or other wellbore operations, which utilizes ultrasound (i.e., acoustic waves characterized by ultrasonic frequencies) to communicate sensor and/or control information from inside a riser and/or blowout preventer (BOP) to outside the riser/BOP, and/or vice versa. More specifically, the communication system may include an internal ultrasonic module (IUM) residing inside the riser/BOP and acoustically coupled to a drill string and/or a centralizer also inside the riser/BOP. The communication system may further include an external ultrasonic module (EUM) residing outside the riser/BOP and acoustically coupled to the riser/BOP. The ultrasound may traverse from the IUM to the EUM, and vice versa, using a communication path that may include propagation of the ultrasound through the drill string, the centralizer, and the (Continued)

riser/BOP without traversal through fluids contained within a fluid column enclosed by the riser/BOP.

13 Claims, 9 Drawing Sheets

(56) References Cited

U.S. PATENT DOCUMENTS

| | | | | |
|---|---|---|---|---|
| 2007/0000667 | A1 | 1/2007 | MacKenzie et al. | |
| 2013/0083627 | A1* | 4/2013 | Yates | E21B 47/18 166/344 |
| 2013/0168081 | A1 | 7/2013 | Yang et al. | |
| 2015/0226054 | A1* | 8/2015 | Schuhrke | E21B 47/14 166/335 |
| 2017/0328143 | A1* | 11/2017 | Ang | E21B 17/1078 |
| 2018/0220380 | A1* | 8/2018 | Croux | H04L 27/00 |

FOREIGN PATENT DOCUMENTS

| | | | |
|---|---|---|---|
| WO | 2018045148 | A1 | 3/2018 |
| WO | 2018117998 | A1 | 6/2018 |

OTHER PUBLICATIONS

Office Action issued in corresponding BR Application No. BR 11 2021 000079 8 dated Sep. 15, 2022 (4 pages).

* cited by examiner

ULTRASONIC THROUGH BARRIER COMMUNICATION SYSTEM FOR IN RISER COMMUNICATION

BACKGROUND

Existing acoustic communication systems for relaying sensor and/or control information from/to running tools during wellbore operations require direct contact with the fluids enclosed within a riser and/or blowout preventer (BOP). To ensure that components (e.g., acoustic transducers) of the acoustic communication systems are always in direct contact with the aforementioned fluids, the riser/BOP is often perforated, or otherwise significantly modified, leading to costly expenditures, long installation times delaying the wellbore operation, and riser/BOP structural compromises.

SUMMARY

In one aspect, embodiments disclosed herein relate to a system, the system including a drill string operatively connected to a running tool conducting a wellbore operation. The system also includes a riser encasing the drill string and the running tool within a fluid column containing a fluid, and an external ultrasonic module (EUM) residing entirely outside the riser, wherein the EUM comprises a first ultrasonic transducer acoustically coupled to the riser.

In some embodiments, the system may include a communication system comprising the EUM and an internal ultrasonic module (IUM). The IUM may reside entirely inside the riser and comprises a second ultrasonic transducer acoustically coupled to the drill string, and the IUM may be operatively connected to the EUM and the running tool. The IUM may be enclosed within a pressure vessel, and the pressure vessel is coupled to the drill string. The IUM and the EUM may exchange information between one another using sets of ultrasonic acoustic waves that propagate along a communication path comprising the drill string and the riser. In some embodiments, the communication path may include the fluid contained in the fluid column. In one or more embodiments, the information exchanged may be one selected from a group consisting of sensor information obtained from the running tool and control information intended for the running tool.

The system may further include, in one or more embodiments, a centralizer disposed and configured to center the drill string within the riser. The second ultrasonic transducer may be acoustically coupled to the centralizer, and the communication path may further include the centralizer.

In another aspect, embodiments disclosed herein relate to an apparatus, the apparatus including an ultrasonic transducer acoustically coupled to a surrounding medium, and a processing unit operatively connected to the ultrasonic transducer. The processing unit may be configured to detect, using the ultrasonic transducer, a first set of ultrasonic acoustic waves propagating within the surrounding medium. The processing unit may also be configured to convert the first set of ultrasonic acoustic waves into a first information pertinent to a wellbore operation. The apparatus may further include a power source configured to provide power to the ultrasonic transducer and the processing unit. In some embodiments, the surrounding medium is one selected from a group consisting of a drill string, a centralizer, a riser, and a blowout preventer (BOP).

In one or more embodiments, the apparatus may include an information interface operatively connected to the processing unit. The power source may be further configured to provide power to the information interface. The processing unit may be further configured to transmit, using the information interface, the first information towards a destination. Further, the processing unit may be configured to: receive, using the information interface, a second information from a source; convert the second information into a second set of ultrasonic acoustic waves; and, emit, using the ultrasonic transducer, the second set of ultrasonic acoustic waves into the surrounding medium.

In some embodiments, the second set of ultrasonic acoustic waves may be modulated using a set of modulation formats comprising at least one selected from a group consisting of a frequency-shift keying (FSK) modulation format, a phase-shift keying (PSK) modulation format, and an orthogonal frequency-division multiplexing (OFDM) modulation format. The second set of ultrasonic acoustic waves may also be emitted on a plurality of different carrier frequencies. For example, each of the plurality of different carrier frequencies is within an inclusive frequency range between 20 kilohertz (kHz) and 1 megahertz (MHz).

The destination and the source may each be selected from a group consisting of a running tool, a surface facility, and an acoustic modem communicatively connected to one selected from another group consisting of a lander, a remotely operated vehicle (ROV), and a subsea control module (SCM).

In another aspect, embodiments disclosed herein relate to a method for enabling communications through a riser during a wellbore operation. The method may include: receiving a first information from a source; converting the first information into a first set of ultrasonic acoustic waves; and emitting the first set of ultrasonic acoustic waves into a surrounding medium and destined for a destination. The method, in some embodiments, may also include: detecting a second set of ultrasonic acoustic waves propagating within the surrounding medium; converting the second set of ultrasonic acoustic waves into a second information; and transmitting the second information to a second destination.

The source, the destination, and the second destination may each be one selected from a first group consisting of a running tool, a surface facility, and an acoustic modem communicatively connected to one selected from a second group consisting of a lander, a remotely operated vehicle (ROV), and a subsea control module (SCM). The surrounding medium may be selected from a third group consisting of the riser, a blowout preventer (BOP), a drill string, and a centralizer. Further, the first information and second information may each be selected from a fourth group consisting of sensor information and control information. The first set of ultrasonic acoustic waves and the second set of ultrasonic acoustic waves may each propagates through a communication path comprising at least the drill string and the riser.

Other aspects disclosed herein will be apparent from the following description and the appended claims.

DETAILED DESCRIPTION

Figure 1:
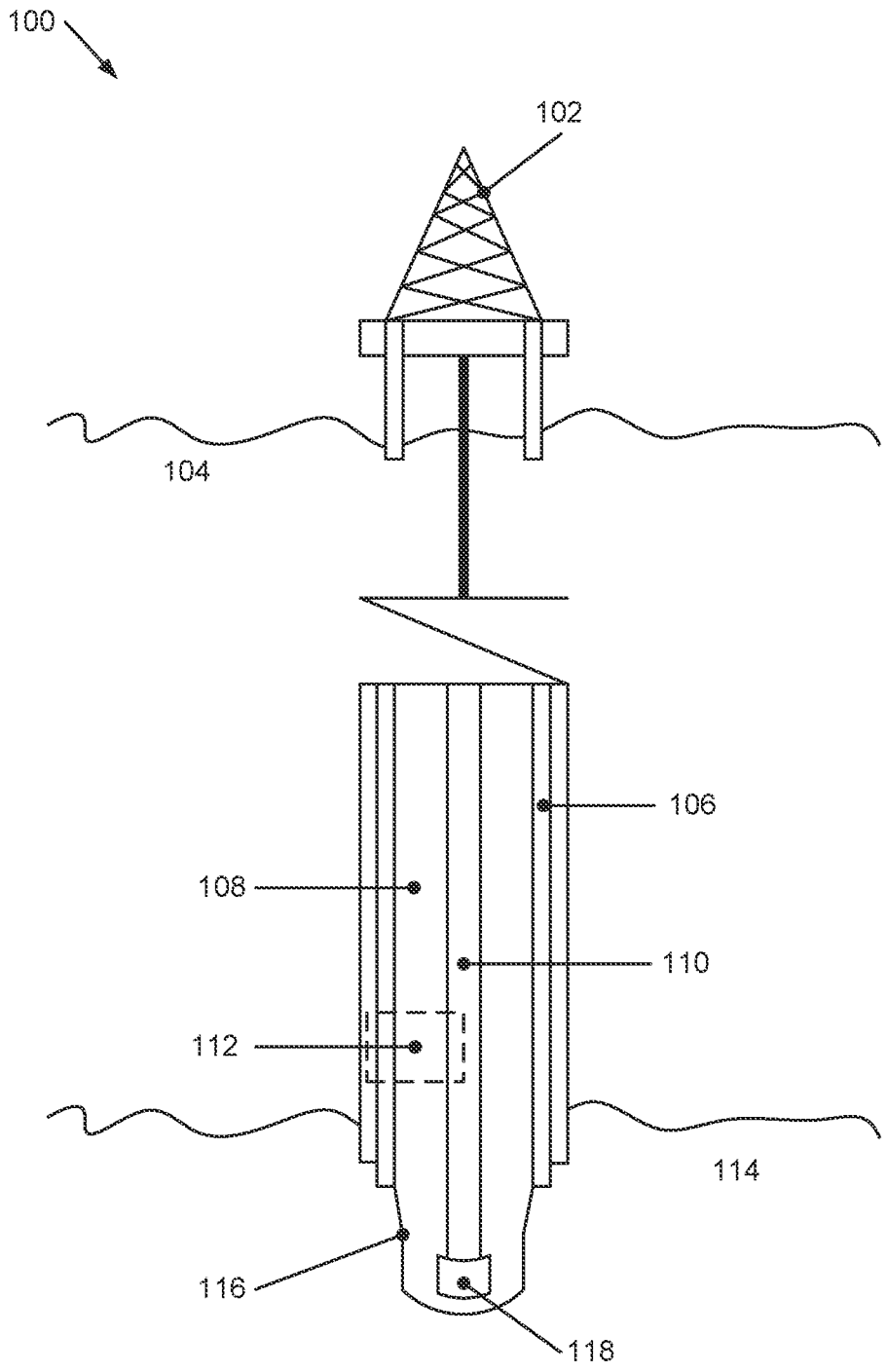
FIG. 1 shows a system in accordance with one or more embodiments disclosed herein.

Specific embodiments disclosed herein will now be described in detail with reference to the accompanying figures. In the following detailed description of the embodiments disclosed herein, numerous specific details are set forth in order to provide a more thorough understanding disclosed herein. However, it will be apparent to one of ordinary skill in the art that embodiments disclosed herein may be practiced without these specific details. In other instances, well-known features have not been described in detail to avoid unnecessarily complicating the description.

In the following description of FIGS. 1 and 3A-5B, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Throughout the application, ordinal numbers (e.g., first, second, third, etc.) may be used as an adjective for an element (i.e., any noun in the application). The use of ordinal numbers is not to necessarily imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein relate to a communication system employed during wellbore operations, such as during drilling, cementing, fracturing, or other wellbore operations known to those skilled in the relevant art. In one or more embodiments, the wellbore operations may be subsea wellbore operations. Specifically, one or more embodiments disclosed herein utilizes ultrasound (i.e., acoustic waves characterized by ultrasonic frequencies) to communicate sensor and/or control information from inside a riser and/or blowout preventer (BOP) to outside the riser/BOP, and/or vice versa. More specifically, the communication system includes an internal ultrasonic module (IUM) residing inside the riser/BOP and acoustically coupled to a drill string and/or a centralizer also inside the riser/BOP. The communication system further includes an external ultrasonic module (EUM) residing outside the riser/BOP and acoustically coupled to the riser/BOP. The ultrasound may traverse from the IUM to the EUM, and vice versa, using a communication path that may include propagation of the ultrasound through the drill string, the centralizer, and the riser/BOP without traversal through fluids contained within a fluid column enclosed by the riser/BOP.

FIG. 1 shows a system in accordance with one or more embodiments disclosed herein. The system (100) may be representative of, for example, an offshore hydrocarbons (e.g., petroleum and/or natural gas) recovery operation. The system (100) may include a surface facility (102), a drill string (110), a running tool (118), a riser and/or blowout preventer (BOP) (106), and a communication system (112). Each of these components is described below.

In one or more embodiments disclosed herein, the surface facility (102) may be a structure or a maritime vessel that may include functionality to extract, process, and store hydrocarbons that lie beneath the seabed (114). The surface facility (102) may often be positioned directly above the wellbore (116) and, further, be at least partially submerged underwater (e.g., at least a portion of the surface facility (102) resides below the ocean surface (104)). In one or more embodiments disclosed herein, a wellbore (116) may be the hole in the seabed (114) produced, by way of drilling, to aid in the exploration and/or recovery of hydrocarbons. One of ordinary skill in the relevant art would appreciate that the surface facility (102) may include additional or alternative functionalities without departing from the scope disclosed herein. Examples of a surface facility (102) include, but are not limited to, an offshore oil platform/rig, an inland barge, a drill ship, a semi-submersible platform/rig, an artificial island, a floating production system (FPSO), a normally unmanned installation (NUI), a satellite platform, etc.

In one or more embodiments disclosed herein, the drill string (110) may be a column, or string, of mostly drill pipe that extends from the surface facility (102) to the wellbore (116). The drill string (110) may further include a bottom hole assembly (BHA) (not shown), which may be a collection of components that include, for example, the running tool (118), drill collars, drilling stabilizers, downhole motors, rotary steerable systems, and various tools (e.g., measurement while drilling (MWD) and logging while drilling (LWD) tools). Further, the drill string (110) may be hollow, thereby enabling the pumping and/or circulation of fluids (e.g., water, compressed air, polymers, water or oil based mud, etc.) from the surface facility (102) to the wellbore (116). The aforementioned fluids may be applied to facilitate the wellbore operation. The drill string (110) may include further functionality to propagate torque to the running tool (118) for operating a drill bit at the bottom of the wellbore (116).

The running tool (118) may be specialized equipment that is used in a variety of operations throughout the wellbore operation. The various operations for which the running tool (118) may be used include, but are not limited to, fishing, casing, cementing, well-bottom communication, drilling, logging, well measurement, and fracturing. The running tool (118) may include one or more sensor(s) (not shown). A sensor may refer to hardware, software, firmware, or any combination thereof, which may include the functionality to detect and measure one or more physical properties (e.g., heat, light, sound, pressure, motion, etc.) or other measurements that may be taken during wellbore operations (e.g., such as tools and/or sensors as may be associated measurement while drilling (MWD) tools, etc.). Examples of a sensor include, but are not limited to, an accelerometer, a pressure sensor, a temperature sensor, a microphone, a camera, a light detector, a fiber optic sensor, etc. The running tool (118) may also include one or more actuator(s) (not shown). An actuator may be an electrical, piezoelectric, electro-mechanical, mechanical, or hydraulic device or mechanism. In addition, an actuator may include functionality to generate stimuli to facilitate the wellbore operation—the nature of which may be kinetic, sensory, thermal, chemical, nuclear, or any other type of stimulus. Examples of an actuator include, but are not limited to, a motor, a fluidic pump, a piezoelectric element, a drill bit, a hydraulic cylinder, a solenoid, a valve, etc. One of ordinary skill in the relevant art would appreciate that the running tool (118) may include further functionalities and/or components without departing from the scope disclosed herein.

The riser (108) may be a conduit for the transportation of hydrocarbons and/or mud (e.g., the fluid column (108)) from the wellbore (116) to the surface facility (102). The riser (106) may include further functionality to transport production materials (e.g., injection fluids, control fluids, etc.) from the surface facility (102) to the wellbore (116). The riser (106) may envelope the drill string (110) and running tool (118), and thereby temporarily extend the wellbore (116) to the surface facility (102). The riser (108) may also be insulated in order to withstand seabed (114) temperatures, and can either be rigid or flexible. The riser (106) may be one of numerous existing or later developed riser types, examples of which include, but are not limited to, an attached riser, a pull tube riser, a steel catenary riser, top-tensioned riser, a riser tower, a flexible riser, and a drilling riser. The riser (106) may be used alongside a blowout preventer (BOP), which may be a specialized valve or similar mechanical device that may include functionality to seal, control, and monitor the wellbore (116) to prevent a blowout. A blowout may refer to the uncontrolled release of hydrocarbons (e.g., crude petroleum and/or natural gas) from the wellbore (116). The BOP may be secured to the top of the wellbore (116) or immediately below the surface facility (102). Examples of a BOP include, but are not limited to, a ram-type BOP and an annular-type BOP.

The communication system (112) may be a mechanism employing a pair of physical devices (not shown) (see e.g., FIG. 4) for enabling remote communication with the running tool (118). The pair of physical devices may include: (i) a first physical device enclosed, alongside the drill string (110) and running tool (118), within the riser/BOP (106)—hereinafter designated the internal ultrasonic module (IUM); and (ii) a second physical device residing outside the riser/BOP (106)—hereinafter designated the external ultrasonic module (EUM). The IUM may be operatively (or communicatively) connected to the running tool (118) through a wired communication medium (e.g., a communication cable (see e.g., FIG. 3D)). Conversely, the EUM may be operatively (or communicatively) connected to the surface facility (102), either directly, through another wired communication medium, or indirectly, through a lander or remotely operated vehicle (ROV) (not shown). The IUM may be acoustically coupled to the drill string (110) and/or a centralizer (not shown) (see e.g., FIG. 3A). Further, the EUM may be acoustically coupled to the riser/BOP (106). Acoustic coupling may intend that a device (e.g., the IUM, the EUM, an ultrasonic transducer) may be in acoustic communication with a surrounding medium (e.g., the drill string (110), the centralizer, the riser/BOP (106)) that may be in direct contact with the device.

As a whole, the communication system (112) may include functionality to: (i) obtain sensor information from one or more sensor(s) on the running tool (118); (ii) transmit the sensor information towards the surface facility (102); (iii) receive control information originating from the surface facility (102); and/or (iv) relay the control information to one or more actuator(s) on the running tool (118). Sensor information, such as readings pertaining to pressure, rotation, heading, and various other physical properties or metrics, may be collected in order to confirm the performance of running tool actions during wellbore operations. The sensor information may subsequently be analyzed (such as at the surface facility (102), or elsewhere) to yield benefits such as cost savings and the reduction of installation times. Control information, such as command signals and/or computer readable program code including instructions for operating the running tool (118) may be provided without requiring an umbilical inside the riser/BOP (106). In contrast, existing communication systems typically use an umbilical (cable or hose) to operatively (or communicatively) connect the running tool and the surface facility, wherein the umbilical may supply the necessary control information, power, and/or other consumables (e.g., chemicals) for operating the running tool.

The communication system (112) may operate by employing ultrasonic frequencies, in the form of acoustic waves, to exchange sensor and/or control information from inside to outside the riser/BOP (106), and vice versa. Further, in one or more embodiments disclosed herein, neither the IUM nor the EUM may be in direct contact with the fluid in the fluid column (108). With respect to the EUM, no direct contact with the fluid column (108) fluid is understandable as the EUM may reside outside the riser/BOP (106). Concerning the IUM, though the IUM may reside inside the riser/BOP (106), the IUM may be enclosed within a pressure vessel designed to shield the IUM from the high temperature and high pressure conditions within the riser/BOP (106) and/or wellbore (116). The EUM may also be enclosed within another pressure vessel (or any other suitable enclosure) for protection against harsh conditions, such as those that may be inflicted by the ocean or other environments in which the EUM may be disposed. With the lack of direct contact with the fluid column (108) fluid, the communication path between the IUM (inside the riser/BOP (106)) and the EUM (outside the riser/BOP (106)) may either source or end with the propagation of the ultrasonic acoustic waves through the drill string (110) (or a centralizer (see e.g., FIG. 3A)) and the riser/BOP (208) wall. In other embodiments disclosed herein, and only when a centralizer is not employed, the aforementioned communication path may be extended to include the fluid contained within the fluid column (108) as well.

Figure 2:
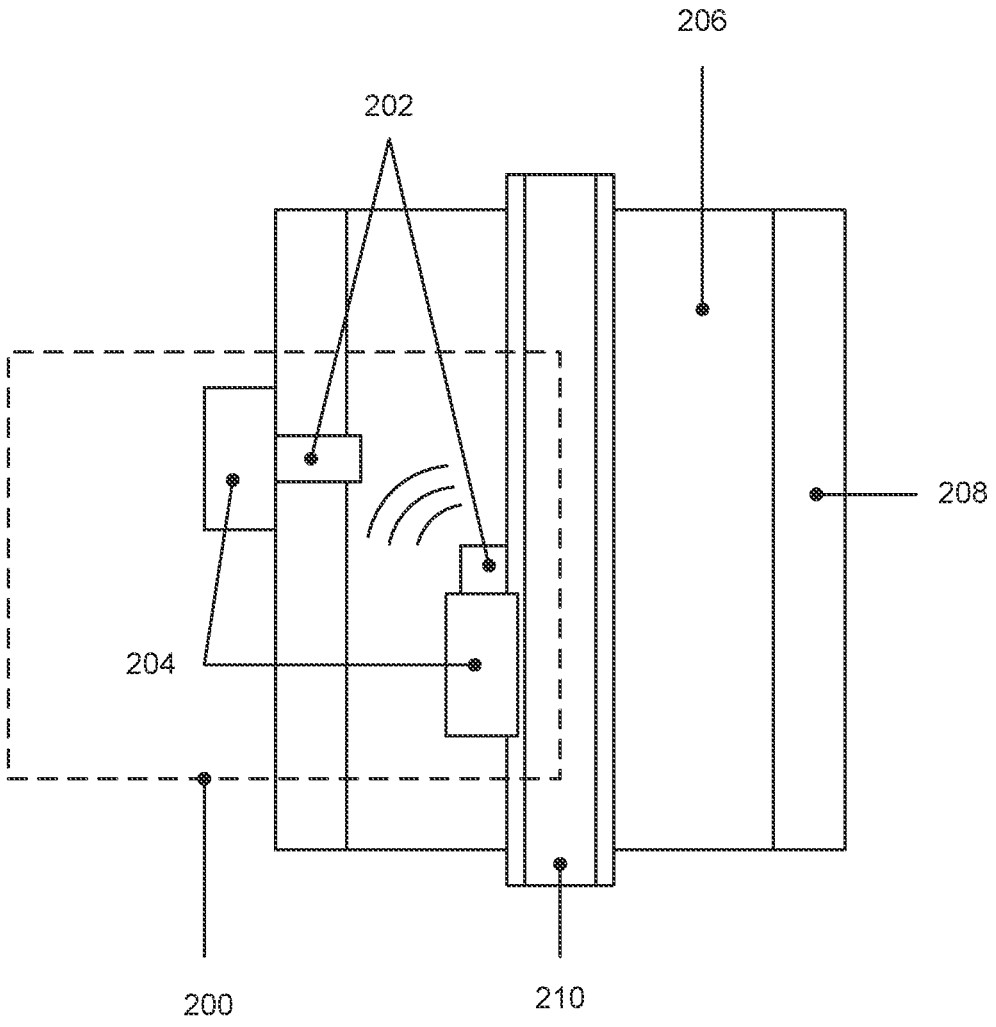
(Prior Art) FIG. 2
FIG. 2 shows an example a prior art communication system.

In contrast, and turning to FIG. 2 momentarily, in existing communication systems, the internal and external devices (202) embodying an existing communication system (200) are required to come into contact with the fluid in the fluid column (206). The former of which may couple to the drill string (210), whereas the latter protrudes through the riser/BOP (208). Substantively, the communication path between the internal and external devices (202) in the existing communication system (200) would include the acoustic waves propagating through the fluid in the fluid column (206) solely. One longstanding issue experienced by existing communication systems (200), perhaps due to, at least in part, this dependence of contacting the fluid column (206) fluid, is the occurrence of multipath interference. Multipath interference refers to a phenomenon whereby, under appropriate conditions, the traveling of a wave (e.g., an acoustic wave) from a source to a detector via multiple paths causes the multiple components of the wave to interfere with one another. Summarily, the interaction between the components of the wave, while the components are at least correlated or coherent with each other, may yield either constructive or destructive interference, thereby amplifying or attenuating the acoustic signal/energy, respectively. Another disadvantage produced by the existing communication system (200) illustrated in FIG. 2 is the need to perforate, or otherwise modify, the riser/BOP (208) in order to ensure that the external device (202) comes into contact with the fluid column (206) fluid. This modification can be costly, and could further require a bonnet (204) to be positioned over the external device (202) in order to contain pressure within the riser/BOP (208), thus adding an uncertain factor that could one day compromise the integrity of the riser/BOP (208).

Proceeding with FIG. 1, the communication system (112) of the embodiments disclosed herein, however, overcomes these above-mentioned issues. For example, the effects of multipath interference may be reduced by employing multiple modulation formats (and/or multiple, different carrier frequencies) to maximize the probability of successful acoustic signal/wave/energy transmission. Effectively, transmission of a same acoustic signal/wave/energy multiple times, whereby each time the acoustic signal/wave/energy is propagated using a different modulation format, may increase the chance of the transmission successfully reaching the detector (e.g., the IUM or the EUM), and without significant attenuation. Examples of the modulation formats that may be employed may include, but are not limited to, the frequency-shift keying (FSK) modulation format, the phase-shift keying (PSK) modulation format, and the orthogonal frequency-division multiplexing (OFDM) modulation format. By way of another example, because the EUM may reside outside the riser/BOP (106) and, in one or more embodiments disclosed herein, does not require contact with the fluid column (108) fluid, perforations and/or any other significant modifications to the riser/BOP (106) are unnecessary or avoidable. Additional details describing the communication system (112) are discussed below with respect to FIGS. 3A-5B.

While FIG. 1 shows a configuration of components, system configurations other than that shown in FIG. 1 may be used without departing from the scope disclosed herein. For example, as mentioned above, the system may include a lander or remotely operated vehicle (ROV) that may be employed for various operations pertinent to wellbore operations.

FIGS. 3A-3D each show a communication system in accordance with one or more embodiments disclosed herein. The following communication system configurations are not intended to limit the scope disclosed herein.

Figure 3A:
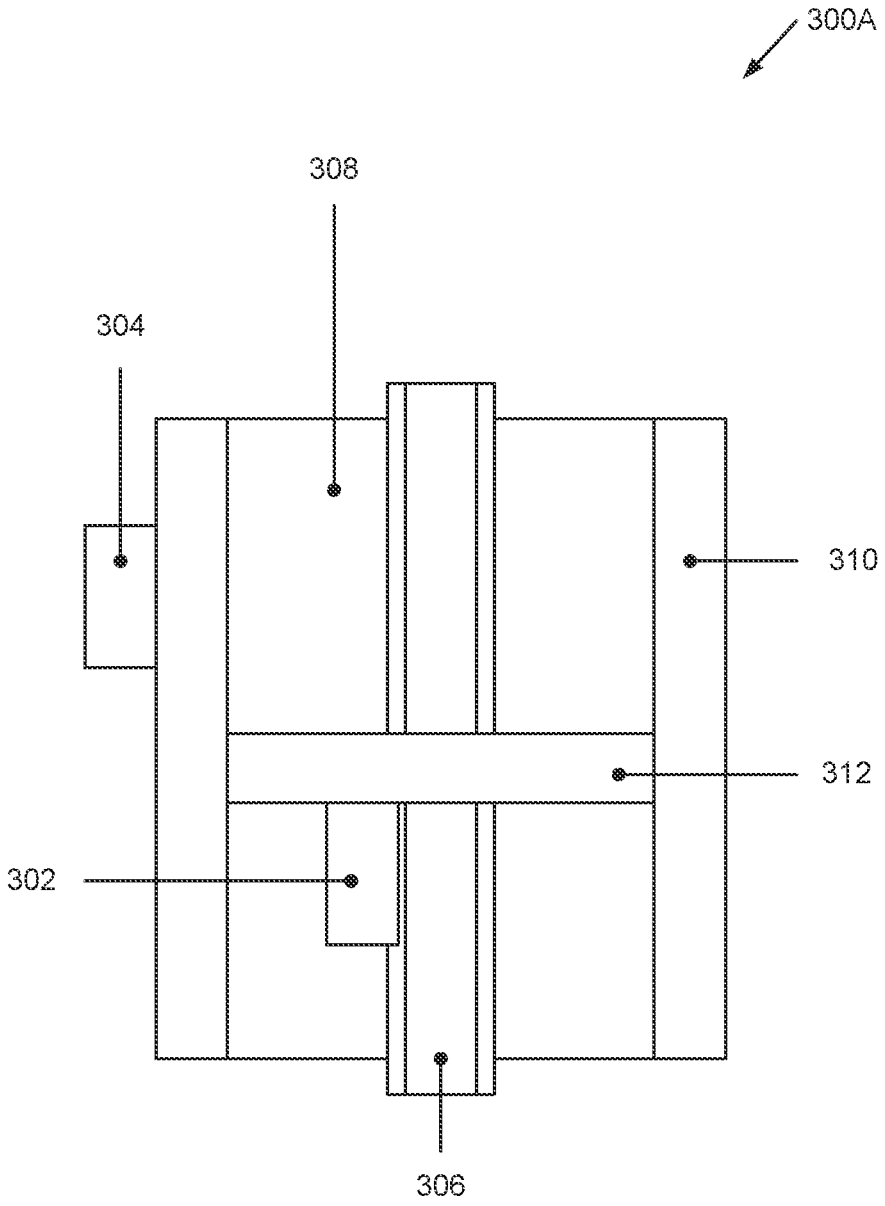
FIGS. 3A-3D each show a communication system in accordance with one or more embodiments disclosed herein.

Turning to FIG. 3A, a configuration (300A) is illustrated that may be contingent on the presence of a centralizer (312) within the riser/BOP (310). A centralizer (312) may be a mechanical device fitted within the riser/BOP (310) and about the drill string (306). The centralizer (312) may include functionality to center the drill string (310) and/or running tool (not shown) in the riser/BOP (310) and wellbore (not shown). In properly centering the drill string (310) and/or running tool inside the riser/BOP (310) and wellbore, the centralizer (312) may: (i) prevent damage to the riser/BOP (310) and/or wellbore; (ii) enable the efficient flow of fluids to/from the wellbore; and (iii) avoid excessive standoff (i.e., distance between the running tool and the wellbore wall), which may affect the response of some sensor measurements, etc. Examples of centralizers used during wellbore operations include, but are not limited to, bow-spring centralizers and rigid-blade centralizers.

Proceeding with FIG. 3A, the use of a centralizer (312) in configuration (300A) of the communication system may be advantageous. It may be advantageous because the centralizer (312) guarantees a contiguous metal-metal communication path through which the ultrasonic acoustic waves propagate. The contiguous metal-metal communication path may maintain a high signal-to-noise ratio (SNR) of the transmitted ultrasonic acoustic waves, thereby minimizing deterioration of the encoded sensor and/or control information. Further, the IUM (302) may be coupled (e.g., magnetically, or otherwise) to the centralizer (312) and/or drill string (306). The IUM (302) may further be acoustically coupled to the centralizer (312) and/or drill string (306). On the other hand, in one or more embodiments disclosed herein, the EUM (304) may be positioned in close contact with, or may be coupled (e.g., magnetically, or otherwise) to, the external wall of the riser/BOP (310). The EUM (304) may further be acoustically coupled to the riser/BOP (310). In one or more embodiments disclosed herein, the communication path traversed by the ultrasonic acoustic waves (generated/transmitted by the IUM or EUM) may include propagation through the centralizer (312) and/or drill string (306) to the riser/BOP (310) wall, and/or vice versa. In configuration (300A), the ultrasonic acoustic waves need not propagate through the fluid contained in the fluid column (308). Also, in implementing the communication system per configuration (300A), higher communication speeds for the exchange of sensor and/or control information may be achieved.

Figure 3B:
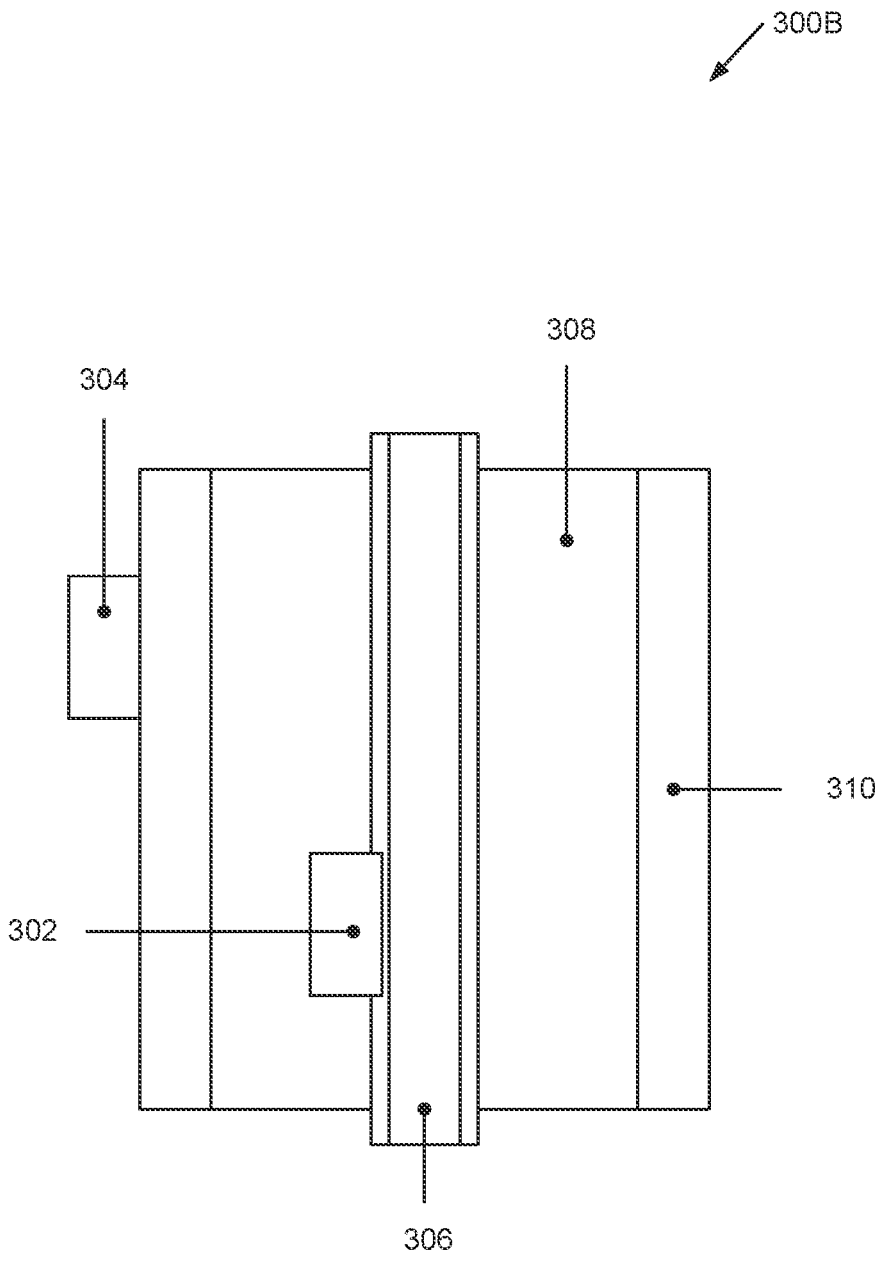

Turning to FIG. 3B, a configuration (300B) is illustrated that operates without the presence of a centralizer. In configuration (300B), the IUM (302) may be coupled (e.g., magnetically, or otherwise) to just the drill string (306), whereas the EUM (304) may be positioned in close contact with, or may also be coupled (e.g., magnetically, or otherwise) to, the external wall of the riser/BOP (310). Without the centralizer, the communication path traversed by the generated/transmitted ultrasonic acoustic waves may include propagation through the drill string (306), the fluid contained in the fluid column (308), and the riser/BOP (310) wall, and/or vice versa. Considering configuration (300B), this approach may be simpler to implement; however, the SNR associated with the transmitted ultrasonic acoustic waves may be reduced due to propagation of the waves through the fluid column (308).

Figure 3C:
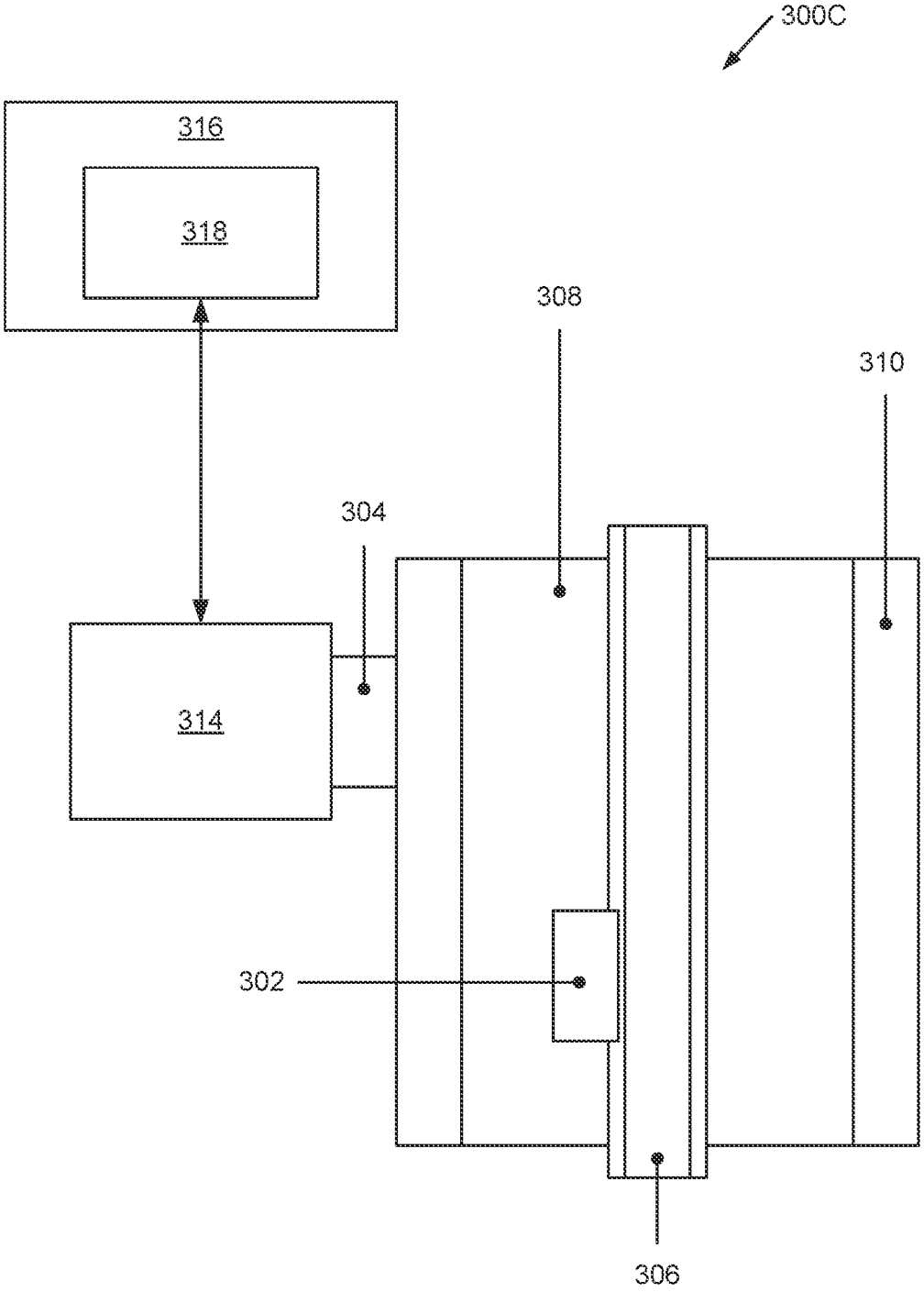

Turning to FIG. 3C, a configuration (300C) is illustrated that employs a lander/ROV (316). In configuration (300C), though a centralizer is not pictured in FIG. 3C, a centralizer may also be employed. The lander/ROV (316) may serve as an indirect medium to obtain or provide control information or sensor information, respectively, from/to the surface facility. One of ordinary skill in the relevant art would appreciate that the lander/ROV (316) may be tethered to the surface facility via an umbilical (not shown), through which the sensor and/or control information may be obtained or provided to the surface facility. Further, similar to the configuration shown in FIG. 3B, the IUM (302) may be coupled (e.g., magnetically, or otherwise) to the drill string (306) while the EUM (304) may be positioned in close contact with, or may also be coupled (e.g., magnetically, or otherwise) to, the external wall of the riser/BOP (310). In another embodiment disclosed herein, when a centralizer may be present, the IUM (302) may additionally, or alternatively, be coupled (e.g., magnetically, or otherwise) to the centralizer. Subsequently, the possible communication paths traversed by the generated/transmitted ultrasonic acoustic waves, between the IUM (302) and the EUM (304), may include propagation through components already mentioned above with respect to FIGS. 3A and 3B.

The configuration (300C) may further include an external module acoustic modem (314) operatively (or communicatively) connected to the EUM (304). An acoustic modem (314, 318) may be a specialized communication device that may include the functionality to facilitate underwater wireless communications. An acoustic modem (314, 318) may be used, in lieu of wired communication methods, for applications whereby the traditional wired communication mediums may be damaged or ineffective due to exposure to harsh subsea environments, and/or whereby real-time information exchange may be necessary. The external module acoustic modem (314) may subsequently be operatively (or communicatively) connected to a lander/ROV acoustic modem (418) on the lander/ROV (316). In another embodiment disclosed herein, the external module acoustic modem (314) may subsequently be operatively (or communicatively) connected to another acoustic modem on a local subsea control module (SCM) (not shown). A SCM may be an underwater functional control system that may serve as a relay for control/data lines, fluids, and/or electrical power from the surface facility to the running tool.

Figure 3D:
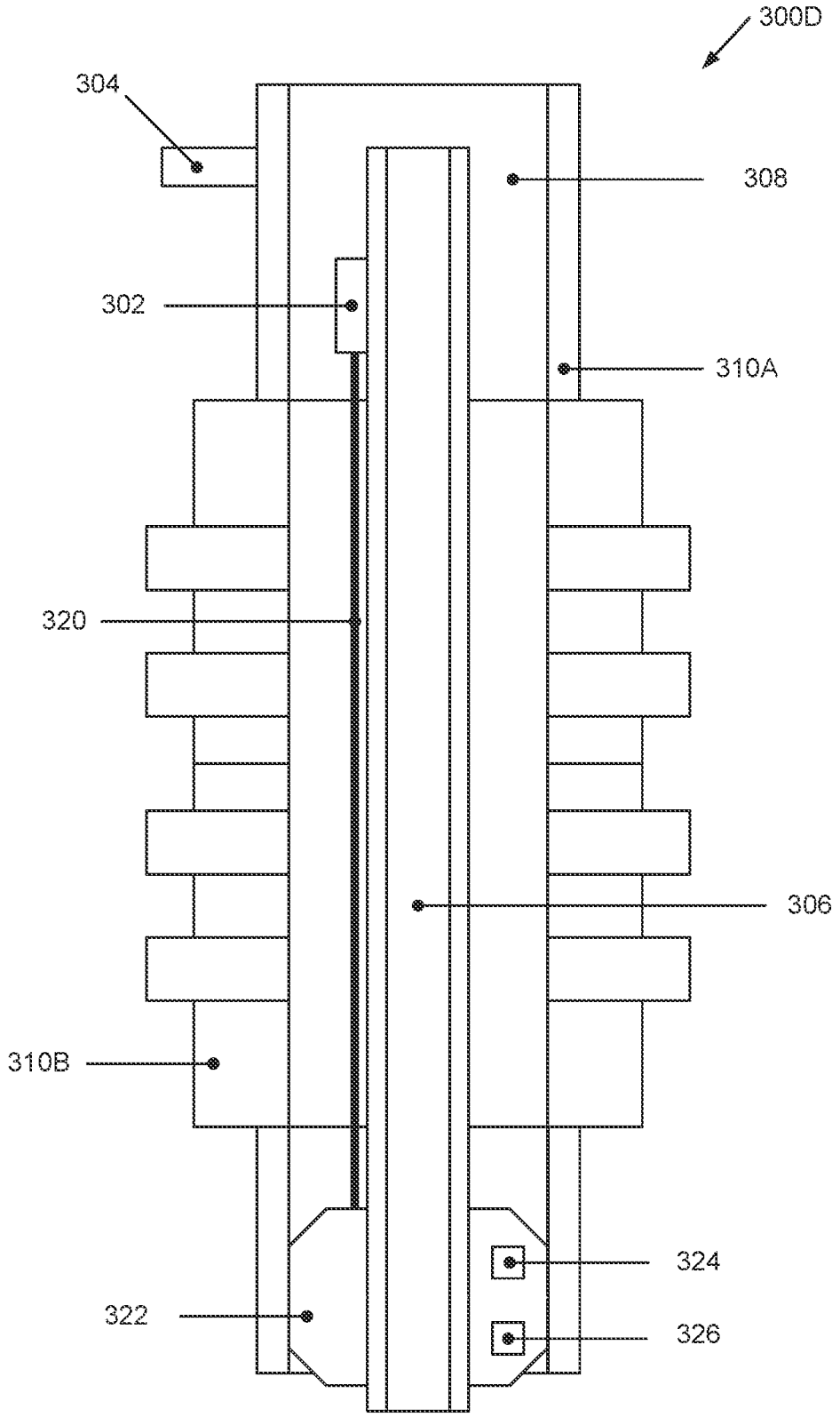

Turning to FIG. 3D, a configuration (300D) is illustrated, representative of an extension to any of the previous configurations (300A-300C), and portraying a cable connection (320) interfacing the communication system with the running tool (322). Specifically, configuration (300D) shows the cable connection (320) operatively (or communicatively) connecting the IUM (302) to the running tool (322). In one or more embodiments disclosed herein, the cable connection (320) may be any rigid or flexible cable assembly that includes one or more electrical conductors (e.g., wires). The cable connection (320) may be insulated or shielded to protect against or compensate for the conditions to which it may be exposed inside the riser (310A), BOP (310B), and/or the wellbore (not shown). The running tool (322), as discussed above, may include one or more sensor(s) (324) and/or one or more actuator(s) (326). In one or more embodiments disclosed herein, sensor information from the one or more sensor(s) (324), as well as control information to the one or more actuator(s) (326), may traverse the cable connection (320) to/from the IUM (302). Further, the sensor and/or control information may propagate, via ultrasonic acoustic waves, to the EUM (304), whereby the aforementioned information eventually ends or sources at the surface facility.

Figure 4:
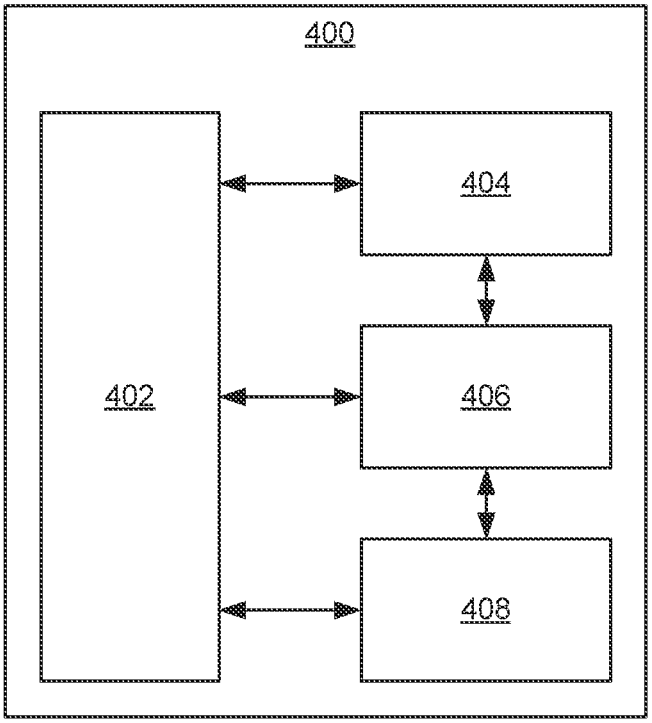
FIG. 4 shows an ultrasonic module in accordance with one or more embodiments disclosed herein.

FIG. 4 shows an ultrasonic module in accordance with one or more embodiments disclosed herein. An ultrasonic module (400) (i.e., the IUM or the EUM) may include a power source (402), an information interface (404), a processing unit (406), and an ultrasonic transducer (408). Each of these components is described below.

The power source (402) may be, for example, a physical, storage medium for, and hence, a source of, direct current (DC) power. The power source (402) may include functionality to provide DC power to any and/or all of the various components (e.g., information interface (404), processing unit (406), and ultrasonic transducer (408)) of the ultrasonic module (400). Further, the power source (402) may be capable of disseminating an appropriate amount of power to each component to which it is operatively connected. In one or more embodiments disclosed herein, the power source (402) may be a device, such as a battery, which is capable of being recharged (e.g., capable of receiving power) from an external source. In such an embodiment, the power source (402) may include a management system (not shown) programmed to oversee the charging and discharging of power to/from the power source (402). The aforementioned management system may also include functionality to monitor the current and/or historical state (e.g., temperature, pressure, leakage, energy, etc.) associated with the power source (402). In one or more embodiments disclosed herein, the management system may be integrated as a portion of the processing unit (406), and thereby, may be implemented as an integrated circuit, a process executing on the processing unit (406), or any combination thereof. In one or more embodiments disclosed herein, the power source (402) may include, but is not limited to, one or more nickel cadmium, nickel metal hydride, lithium ion, or any other type of power cell(s).

In one or more embodiments disclosed herein, the information interface (404) may be hardware, software, firmware, or any combination thereof, which may serve to enable and facilitate the acquisition and transmission of sensor and/or control information to/from components outside the communication system. With respect to the IUM of the communication system, the information interface (404) may enable/facilitate communications to/from the running tool. Further, with regard to the EUM of the communication system, the information interface (404) may enable/facilitate communications to/from the surface facility directly, or indirectly via an acoustic modem paired to another acoustic modem on a lander/ROV and/or a SCM. In one or more embodiments disclosed herein, the information interface (404) may employ any combination of wired and/or wireless connections to receive and/or transmit the sensor and/or control information. In addition, the information interface (404) may employ any combination of existing or later developed wired and/or wireless communication protocols.

In one or more embodiments disclosed herein, the information interface (404) may include the functionality to: (i) receive and decode, at a first port of the information interface (404), sensor and/or control information from the running tool and/or surface facility, wherein the sensor and/or control information may be received as packets, messages, or any other unit of data particular to the wired and/or wireless communication protocol employed; (ii) generate and encode sensor and/or control information into packets, messages, or any other unit of data particular to the wired and/or wireless communication protocol employed; and (iii) transmit, from a second port of the information interface (404), sensor and/or control information, in the form of one or more of any unit of data, to the surface facility and/or running tool. In one or more embodiments disclosed herein, the information interface (404) may support half-duplex and/or full-duplex communication. Examples of the information interface (404) may include, but are not limited to, a network interface controller or device, a network socket, a serial communication interface (SCI), a fiber optic interface or controller, a modem, etc.

In one or more embodiments disclosed herein, the processing unit (406) may be one or more processor(s) and/or integrated circuit(s) for processing instructions. The instructions may take the form of computer readable program code, which, when executed by the processing unit (406), enables the ultrasonic module (400) to perform functions described below in accordance with one or more embodiments disclosed herein (see e.g., FIGS. 5A and 5B). Further, the instructions may be stored, in whole or in part, temporarily or permanently, on a non-transitory computer readable medium (not shown) such as a persistent storage device, flash memory, physical memory, or any other computer readable storage medium. Examples of the processing unit (406) may include, but are not limited to, one or more of an application specific integrated circuit (ASIC), a discrete processor, a field programmable field array (FPGA), a digital signal processor (DSP), a microcontroller, or any other type of integrated circuit or combination thereof.

In one or more embodiments disclosed herein, the ultrasonic transducer (408) may include one or more transducing element(s), each of which may include the functionality to convert sensor and/or control information into ultrasound, or vice versa. Ultrasound corresponds to acoustic waves or other vibrations having an ultrasonic frequency. In one or more embodiments disclosed herein, each element of the ultrasonic transducer (408) may emit and/or detect ultrasounds operating in the frequency range from 20 kilohertz (kHz) to 1 megahertz (MHz) and may support data rates between the order of 100 to 10,000 bits per second (bps). In one or more embodiments disclosed herein, the ultrasonic transducer (408) may generate and/or detect longitudinal pressure waves in the surrounding medium (e.g., the drill string, the centralizer, and the riser/BOP wall). Further, the aforementioned conversion of the sensor and/or control information into ultrasound, acoustic waves, or other vibrations may be implemented in accordance with the piezoelectric effect. In one or more embodiments disclosed herein, the ultrasonic transducer (408) may be acoustically coupled to a riser/BOP, a drill string, and/or a centralizer (see e.g., FIGS. 3A-3D).

In one or more embodiments disclosed herein, the ultrasonic transducer (408) may include: (i) a transmitter element capable of converting sensor and/or control information into ultrasound and emitting the ultrasound; (ii) a receiver element capable of detecting and converting ultrasound to sensor and/or control information; and/or (iii) a transceiver element capable of all abilities outlined in (i) and (ii). Further, in one or more embodiments disclosed herein, the ultrasonic transducer (408) may be configured for one-way or two-way communication between the IUM and the EUM. In considering two-way communications, half-duplex communication may be implemented whereby the IUM/EUM (400) may transmit ultrasound one at a time. In another embodiment disclosed herein, full-duplex communication may be implemented whereby the both the IUM and EUM (400) may transmit ultrasound simultaneously. The transmitted ultrasounds may be encoded using different modulation formats and/or different carrier frequencies to avoid interference. Examples of the ultrasonic transducer (408) may include, but are not limited to, a piezoelectric ultrasonic transducer, a piezo-ceramic ultrasonic transducer, a polyvinylidene fluoride (PVDF) ultrasonic transducer, a high intensity focused ultrasound (HIFU) transducer, a shear wave ultrasonic transducer, etc.

Figure 5A:
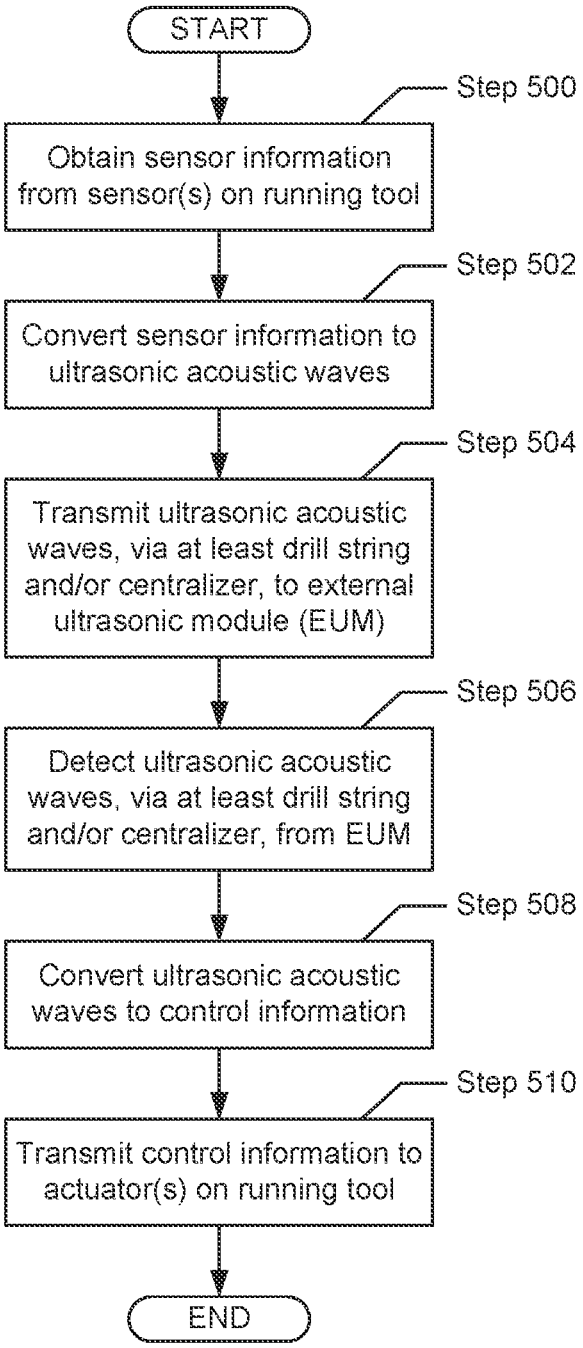
FIG. 5A shows a flowchart describing a method for functions performed by an internal ultrasonic module in accordance with one or more embodiments disclosed herein.
Figure 5B:
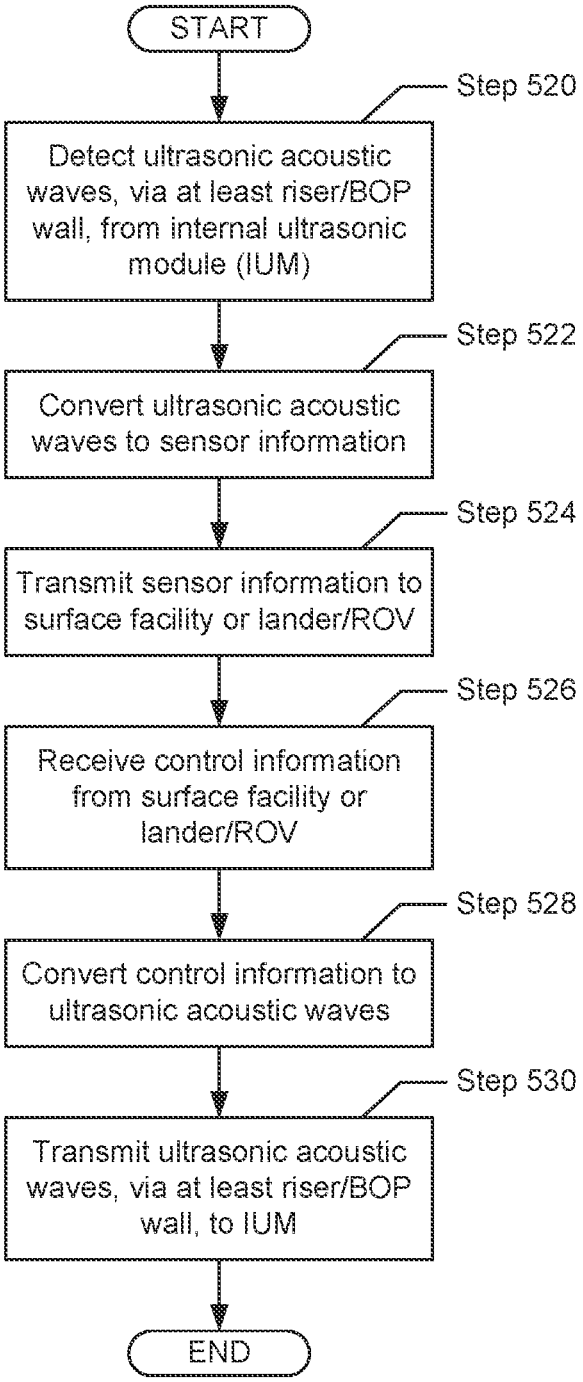
FIG. 5B shows a flowchart describing a method for functions performed by an external ultrasonic module in accordance with one or more embodiments disclosed herein.

FIGS. 5A and 5B show flowcharts in accordance with one or more embodiments disclosed herein. While the various steps in these flowcharts are presented and described sequentially, one of ordinary skill in the relevant art will appreciate that some or all steps may be executed in different orders, may be combined, or omitted, and some or all of the steps may be executed in parallel. In one or more embodiments disclosed herein, the steps shown in FIGS. 5A and 5B may be performed in parallel with any other steps shown in FIGS. 5A and 5B without departing from the scope disclosed herein.

Turning to FIG. 5A, FIG. 5A shows a flowchart describing a method for functions performed by an internal ultrasonic module (IUM) in accordance with one or more embodiments disclosed herein. In Step 500, sensor information is obtained from one or more sensor(s) on the running tool. In one or more embodiments disclosed herein, the acquisition of the sensor information may take the form of a pushing mechanism (e.g., the active generation and transmission of readings/measurements from one or more sensor(s) to the IUM). In another embodiment disclosed herein, the acquisition of the sensor information may take the form of a pulling mechanism (e.g., the polling or requesting, by the IUM, for readings/measurements from one or more sensor(s)).

In Step 502, the sensor information (obtained in Step 500) is converted into a set of ultrasonic acoustic waves. In one or more embodiments disclosed herein, as discussed above, conversion of the sensor information into ultrasounds (i.e., the set of ultrasonic acoustic waves) may be achieved through implementation of the piezoelectric effect, and carried out by the ultrasonic transducer on the IUM (see e.g., FIG. 4).

In Step 504, the set of ultrasonic acoustic waves (generated in Step 502) representative of the sensor information is subsequently transmitted. In one or more embodiments disclosed herein, the set of ultrasonic acoustic waves may be transmitted using different modulation formats and/or different carrier frequencies. In one or more embodiments disclosed herein, because the IUM may be coupled to the drill string and/or a centralizer, the transmitted set of ultrasonic acoustic waves may propagate along the drill string and/or centralizer, potentially, through the fluid contained in the fluid column, and finally, along the riser/BOP wall. Once the transmitted set of ultrasonic acoustic waves propagate to, and induce vibrations within, the riser/BOP wall, in one or more embodiments disclosed herein, the transmitted set of ultrasonic acoustic waves may be detected and converted by the EUM (see e.g., FIG. 5B).

In Step 506, another set of ultrasonic acoustic waves is detected by the IUM. In one or more embodiments disclosed herein, this other set of ultrasonic acoustic waves may be detectable to the IUM once the set of ultrasonic acoustic waves propagate to, and induce vibrations within, the drill string and/or centralizer to which the IUM may be coupled. In one or more embodiments disclosed herein, the communication path taken by this other set of ultrasonic acoustic waves towards arriving proximal to the IUM may include propagation along the riser/BOP, potentially, through the fluid contained in the fluid column, and finally, along the drill string and/or centralizer.

In Step 508, the other set of ultrasonic acoustic waves (detected in Step 506) is converted into control information. In one or more embodiments disclosed herein, conversion of the detected ultrasounds (e.g., the other set of ultrasonic acoustic waves) into control information may be achieved through implementation of the piezoelectric effect (i.e., because the piezoelectric effect is reversible) and carried out by the ultrasonic transducer on the IUM. In one or more embodiments disclosed herein, conversion of the detected ultrasounds into control information may further include the application of any of a variety of existing or later developed demodulation techniques on the detected ultrasounds. In demodulating the detected ultrasounds, the original information (i.e., the control information) may be extracted from the modulated carrier waves that may have been generated, by the EUM, towards transmitting the control information to the IUM.

In Step 510, the control information (obtained in Step 508) is transmitted to one or more actuator(s) on the running tool. In one or more embodiments disclosed herein, as mentioned above, the control information may take the form of command signals and/or computer readable program code including instructions for operating the one or more actuator(s). Further, as illustrated in FIG. 3D, the control information is transmitted to the one or more actuator(s) by way of a cable connection operatively (or communicatively) connecting the IUM to the running tool, and vice versa.

Turning to FIG. 5B, FIG. 5B shows a flowchart describing a method for functions performed by an external ultrasonic module (EUM) in accordance with one or more embodiments disclosed herein. In Step 520, a set of ultrasonic acoustic waves is detected by the EUM. In one or more embodiments disclosed herein, the set of ultrasonic acoustic waves may be detectable to the EUM once the set of ultrasonic acoustic waves propagate to, and induce vibrations within, the riser/BOP wall to which the EUM may be coupled. In one or more embodiments disclosed herein, the communication path taken by the set of ultrasonic acoustic waves towards arriving proximal to the EUM may include propagation along the drill string and/or centralizer, potentially, through the fluid contained in the fluid column, and finally, along the riser/BOP wall.

In Step 522, the set of ultrasonic acoustic waves (detected in Step 520) is converted into sensor information. In one or more embodiments disclosed herein, conversion of the detected ultrasounds (e.g., the set of ultrasonic acoustic waves) into sensor information may be achieved through implementation of the piezoelectric effect and carried out by the ultrasonic transducer on the EUM. In one or more embodiments disclosed herein, conversion of the detected ultrasounds into sensor information may further include the application of any of a variety of existing or later developed demodulation techniques on the detected ultrasounds. In demodulating the detected ultrasounds, the original information (i.e., the sensor information) may be extracted from the modulated carrier waves that may have been generated, by the IUM, towards transmitting the sensor information to the EUM.

In Step 524, the sensor information (obtained in Step 522) is transmitted towards the surface facility. In one or more embodiments disclosed herein, the sensor information may be transmitted directly to the surface facility through a cable connection operatively (or communicatively) connecting the EUM to the surface facility, and vice versa. In another embodiment disclosed herein, the sensor information may be transmitted indirectly towards the surface facility through a lander/ROV and/or a SCM utilizing acoustic modems (as discussed above).

In Step 526, whether relevant or irrelevant to the sensor information transmitted to the surface facility in Step 524, control information is received that may have originated from the surface facility. In one or more embodiments disclosed herein, the control information may be received directly from the surface facility through the above-mentioned cable connection. In another embodiment disclosed herein, the control information may be received indirectly from the surface facility through a lander/ROV and/or a SCM utilizing acoustic modems. In one or more embodiments disclosed herein, the control information may take the form of command signals and/or computer readable program code including instructions for operating the one or more actuator(s) on the running tool.

In Step 528, the control information (received in Step 526) is converted into another set of ultrasonic acoustic waves. In one or more embodiments disclosed herein, as discussed above, conversion of the control information into ultrasounds (i.e., the other set of ultrasonic acoustic waves) may be achieved through implementation of the piezoelectric effect, and carried out by the ultrasonic transducer on the EUM.

In Step 530, the other set of ultrasonic acoustic waves (generated in Step 528) representative of the control information is transmitted. In one or more embodiments disclosed herein, the other set of ultrasonic acoustic waves may be transmitted using different modulation formats and/or different carrier frequencies. In one or more embodiments disclosed herein, because the EUM may be coupled to the riser/BOP wall, the transmitted set of ultrasonic acoustic waves may propagate along the riser/BOP wall, potentially, through the fluid contained in the fluid column, and finally, along the drill string and/or centralizer. Once the transmitted set of ultrasonic acoustic waves propagate to, and induce vibrations within, the drill string and/or centralizer, in one or more embodiments disclosed herein, the transmitted set of ultrasonic acoustic waves may be detected and converted by the IUM (see e.g., FIG. 5A).

While the embodiments disclosed herein have been described with respect to a limited number of embodiments, those skilled in the art, having benefit of this disclosure, will appreciate that other embodiments can be devised which do not depart from the scope disclosed herein as disclosed herein. Accordingly, the scope disclosed herein should be limited only by the attached claims.

What is claimed is:

1. A system, comprising:

a drill string operatively connected to a running tool conducting a wellbore operation;

a riser encasing the drill string and the running tool within a fluid column containing a fluid;

an external ultrasonic module (EUM) residing entirely outside the riser, wherein the EUM comprises a first ultrasonic transducer acoustically coupled to the riser;

a communication system comprising the EUM and an internal ultrasonic module (IUM); and a centralizer disposed, and configured to center the drill string, within the riser, wherein the IUM resides entirely inside the riser and comprises a second ultrasonic transducer acoustically coupled to the drill string, wherein the second ultrasonic transducer is further acoustically coupled to the centralizer, wherein the IUM is operatively connected to the EUM and the running tool, wherein the IUM and the EUM exchange information between one another using sets of ultrasonic acoustic waves that propagate along a communication path comprising the drill string, the centralizer, and the riser without traversal through the fluid contained within the fluid column enclosed by the riser.

2. The system of claim 1, wherein the IUM is enclosed within a pressure vessel, wherein the pressure vessel is coupled to the drill string.

3. The system of claim 1, wherein the information is one selected from a group consisting of sensor information obtained from the running tool and control information intended for the running tool.

4. An apparatus, comprising:

an ultrasonic transducer acoustically coupled to a surrounding medium;

a processing unit operatively connected to the ultrasonic transducer and configured to:

detect, using the ultrasonic transducer, a first set of ultrasonic acoustic waves propagating within the surrounding medium, and convert the first set of ultrasonic acoustic waves into a first information pertinent to a wellbore operation; and a power source configured to provide power to the ultrasonic transducer and the processing unit, wherein the surrounding medium is a communication path comprising a drill string, a centralizer, a riser, and a blowout preventer (BOP) without traversal through a fluid contained within a fluid column enclosed by the riser.

5. The apparatus of claim 4, wherein the first information is one selected from a group consisting of sensor information and control information.

6. The apparatus of claim 4, further comprising:

an information interface operatively connected to the processing unit, wherein the power source is further configured to provide power to the information interface, wherein the processing unit is further configured to:

transmit, using the information interface, the first information towards a destination.

7. The apparatus of claim 6, wherein the processing unit is further configured to:

receive, using the information interface, a second information from a source;

convert the second information into a second set of ultrasonic acoustic waves; and emit, using the ultrasonic transducer, the second set of ultrasonic acoustic waves into the surrounding medium.

8. The apparatus of claim 7, wherein the second set of ultrasonic acoustic waves is modulated using a set of modulation formats comprising at least one selected from a group consisting of a frequency-shift keying (FSK) modulation format, a phase-shift keying (PSK) modulation format, and an orthogonal frequency-division multiplexing (OFDM) modulation format.

9. The apparatus of claim 7, wherein the second set of ultrasonic acoustic waves is emitted on a plurality of different carrier frequencies.

10. The apparatus of claim 9, wherein each of the plurality of different carrier frequencies is within an inclusive frequency range between 20 kilohertz (kHz) and 1 megahertz (MHz).

11. The apparatus of claim 7, wherein the destination and the source are each one selected from a group consisting of a running tool, a surface facility, and an acoustic modem communicatively connected to one selected from another group consisting of a lander, a remotely operated vehicle (ROV), and a subsea control module (SCM).

12. A method for enabling communications through a riser during a wellbore operation, comprising:

receiving a first information from a source;

converting the first information into a first set of ultrasonic acoustic waves;

emitting the first set of ultrasonic acoustic waves into a surrounding medium and destined for a destination;

detecting a second set of ultrasonic acoustic waves propagating within the surrounding medium;

converting the second set of ultrasonic acoustic waves into a second information; and transmitting the second information to a second destination, wherein the first set of ultrasonic acoustic waves and the second set of ultrasonic acoustic waves each propagates through a communication path comprising at least a drill string, a centralizer, and the riser without traversal through a fluid contained within a fluid column enclosed by the riser.

13. The method of claim 12, wherein the source, the destination, and the second destination are each one selected from a first group consisting of a running tool, a surface facility, and an acoustic modem communicatively connected to one selected from a second group consisting of a lander, a remotely operated vehicle (ROV), and a subsea control module (SCM), wherein the surrounding medium is one selected from a third group consisting of the riser, a blowout preventer (BOP), a drill string, and a centralizer, wherein the first information and second information are each one selected from a fourth group consisting of sensor information and control information.

* * * * *